United States Patent [19]

Mugrauer et al.

[11] Patent Number: 4,474,567

[45] Date of Patent: Oct. 2, 1984

[54] PAPER STACKER FOR A PRE-FOLDED CONTINUOUS PAPER WEB

[75] Inventors: Hubert Mugrauer, Poering; Gerhard Mueller, Taufkirchen; Friedrich De Carli, Munich, all of Fed. Rep. of Germany

[73] Assignee: Siemens Aktiengesellschaft, Berlin & Munich, Fed. Rep. of Germany

[21] Appl. No.: 541,059

[22] Filed: Oct. 12, 1983

Related U.S. Application Data

[63] Continuation of Ser. No. 366,358, Apr. 7, 1982, abandoned.

[30] Foreign Application Priority Data

Apr. 16, 1981 [DE] Fed. Rep. of Germany ..... 3115511

[51] Int. Cl.[3] ..... B65H 45/00

[52] U.S. Cl. ..... 493/410

[58] Field of Search ..... 270/30; 493/409–415

[56] References Cited

U.S. PATENT DOCUMENTS 3,917,250 11/1975 Branick ..... 270/30
3,942,300 3/1976 White ..... 270/30 X
4,054,283 10/1977 Rayfield .
4,172,592 10/1979 Müeller et al. .

FOREIGN PATENT DOCUMENTS 1236895 10/1965 Fed. Rep. of Germany ..... 493/415
2435054 2/1976 Fed. Rep. of Germany .

*Primary Examiner*—A. J. Heinz
*Attorney, Agent, or Firm*—Hill, Van Santen, Steadman & Simpson

[57] ABSTRACT

A stacking device for pre-folded endless paper web in a paper stacker is provided with a stationary stack support or deposit surface and a piler means disposed for movement over the deposit surface for receiving and folding the paper web along its crease lines in zig-zag layers on the paper stack. The invention offers the advantage that the movable elements of the paper stacker have significantly lighter and constant masses, so that the inventive structure may be made less expensively than conventional, known paper stacker arrangements. Between the feed roll means delivering the paper web into the stacker and the relatively movable piler, there is provided a guidance means for conducting the paper web in non-collapsing fashion downwardly within the stacker to the piler. The guidance means is constructed so as to automatically vary in length in accordance with the changing working height of the piler during stacking operation. The guidance means may be in the form of a plurality of synthetic bands provided along opposed sides of the paper web wherein the bands are connected at their upper ends to automatic tensioning means which maintain the bands under tension and allow the bands to lengthen or contract in accordance with the relative movement of the piler.

10 Claims, 4 Drawing Figures

PAPER STACKER FOR A PRE-FOLDED CONTINUOUS PAPER WEB

BACKGROUND OF THE INVENTION

This is a continuation of application Ser. No. 366,358, filed April 7, 1982, now abandoned.

The invention relates to a stacking device for a pre-folded endless paper web in a paper stacker, in which the paper web is supplied to a piler device along paper guidance means and is laid down in zig-zag layers to form a paper stack on a stationary deposit surface and in which the relative spacing between the piler device and the upper surface of the stack is held approximately constant.

In printer devices employing folded endless paper webs which are to be processed, the printed paper web must be laid down or stacked in folded relation in a stacker unit. Transverse pre-folded perforation lines on the paper web enable the paper stack to be formed by zig-zag layering of the web. Paper stacker units serve as accessories for mechanical and non-mechanical high speed printers for receiving the printed paper web.

Typical known paper stackers, such as disclosed in U.S. Pat. Nos. 4,054,283 and 4,172,592 and German O.S. No. 2,435,054, utilize stationarily mounted piler devices having guide and folding mechanisms connected therewith for conducting and layering continuous paper webs onto corresponding stacks. The stacks are formed on stack deposit or support surfaces which are adapted for vertical movement controlled by stack height sensors for lowering the deposit surfaces in accordance with the ascending height of the paper stacks. The deposit surfaces are lowered by suitable drive devices which serve to maintain an approximately constant spacing between the piler devices and the uppermost surface of the growing stack.

These known constructions for paper stacking devices require the stack deposit or support surfaces to be in the form of suitably heavy machinery for supporting the full weight of a formed paper stack for movement in the stackers. In contrast, the present invention is directed to a novel paper stacker having a relatively less expensive construction and in which stack weights of paper are more easily handled and the danger of accidents and wear can be reduced.

SUMMARY OF THE INVENTION

A paper stacker for receiving a line of pre-folded endless paper web from a printer machine and laying down the paper web in zig-zag layers one above the other in a stack is provided with a stationary stack supporting or deposit surface over which is mounted a web piler device connected to a drive means for vertical movement enabling it to overlie the uppermost portion of the stack at a substantial constant spacing. A paper guidance means is coupled to the upper end of the piler device and automatically adapts in length to the respective working height of the piler in the stacker. As a result of this construction, the growing paper stack is not moved within the stacker during stacking operation, since the stack is formed on the stationary deposit surface. The movable elements of the stacker are unaffected by the growing weight of the paper stack, such that these movable elements operate on constant masses which are significantly smaller than that of paper stacks which must be moved in typical known paper stacker arrangements. Accordingly, constructions for the guidance means and the drive means controlling the piler device are significantly lightweight and have relatively low manufacturing costs.

Further advantages of the relatively lightweight construction of the paper stacker elements afforded by the present invention are that, in the event of stacking errors or power outages, the piler device can be manually raised for stack removal. Also, the operation of the stacker is relatively simplified and this facilitates the step of stack removal in comparison to prior known paper stacker arrangements. The path length for paper passing between a printer output and the piler device is relatively lengthened, which permits more complete drying and cooling of the printed paper web. This is particularly beneficial with regard to use with non-mechanical printers.

The paper guidance means are adapted to automatically vary in length in accordance with the working height of the piler device in the stacker. Various possibilities for construction of the variable length paper guidance means are within the contemplation of the present invention. One contemplated example is the use of vertically extending guidance channels positioned on opposed sides of the downwardly directed paper web entering the stacker and designed to be collapsed and extended in telescope-like fashion depending on the vertical movement of the piler device. The guidance channels have upper ends fixedly attached adjacent feed rolls through which the paper web is threaded from the printer and lower ends fixedly attached to the upper surface of the piler device. Each of the guidance channels is formed of at least two relatively sliding parts, such that the lower part attached to the piler device slides along the upper part during movement of the piler in the stacker. It is desirable that the guidance channels comprise a plurality of narrow individual channels spaced apart from one another at equal intervals along the width of the paper web in a row extending perpendicular to the direction of movement of the web. In this manner, the paper web is accessible and visible through spacings between the channels and the overall material outlay for the channels is at a minimum.

In accordance with the preferred embodiment for the paper guidance means, tapes, bands, or ropes made of flexible synthetic material are held in tension along vertical lines on opposed sides of the paper web as the web extends downward in the stacker between the feed rolls and the piler device. The upper ends of the bands are wrapped around corresponding rollers mounted at spaced intervals along a rotatable laterally extending shaft disposed in the stacker. The lower ends of the bands are respectively secured to the upper surface of the piler device and the bands together form a guidance channel which is vertically extending in the stacker and which is variable in length depending upon the relative movement of the piler device in the stacker. The shaft on which the rollers are mounted is in the form of a pre-stressed windup shaft connected to a pre-stressed windup mechanism, having, for example, a spiral band spring connected to the shaft. Alternatively, the bands could be made of elastic, resilient material connected at their upper ends to a support rod and their lower ends to the piler device, such that the elastic bands automatically contract when the guidance channel is shortened and expand when the guidance channel is lengthened. In this manner, the windup shaft and attendant pre-tensioned elements.

The use of bands made of flexible material takes up even less space and is even less costly than a guidance structure using telescoping parts. Rather than a plurality of narrow bands distributed at spaced intervals across the width of the paper in a row at right angles to the direction of movement of the paper web through the stacker, a pair of broad bands may be provided at both sides of the guidance channel. In any case, the bands are arranged to be of variable length in the stacker depending upon the relative vertical movement of the piler device.

The piler device is guided for vertical movement in the stacker by vertically extending guide track members disposed along the outer edges of the piler. A drive means for moving the piler may comprise at least one endless chain threaded about vertically spaced sprocket wheels, wherein one of the sprocket wheels is connected to a driven shaft operated by a reversible rotary motor having an armature stop brake. The armature stop brake is controlled by a free-wheel which can be blocked by the dead weight of the piler, in a manner similar to known drive means used for the movement of stack support or deposit surfaces of previously known paper stackers. The difference, however, is that in accordance with the instant invention, only the piler device is lifted during stack formation, whereas, in known paper stacker arrangements, it is the deposit surface that is vertically lowered during growth of the stack.

DESCRIPTION OF THE PREFERRED EMBODIMENT

Figure 1:
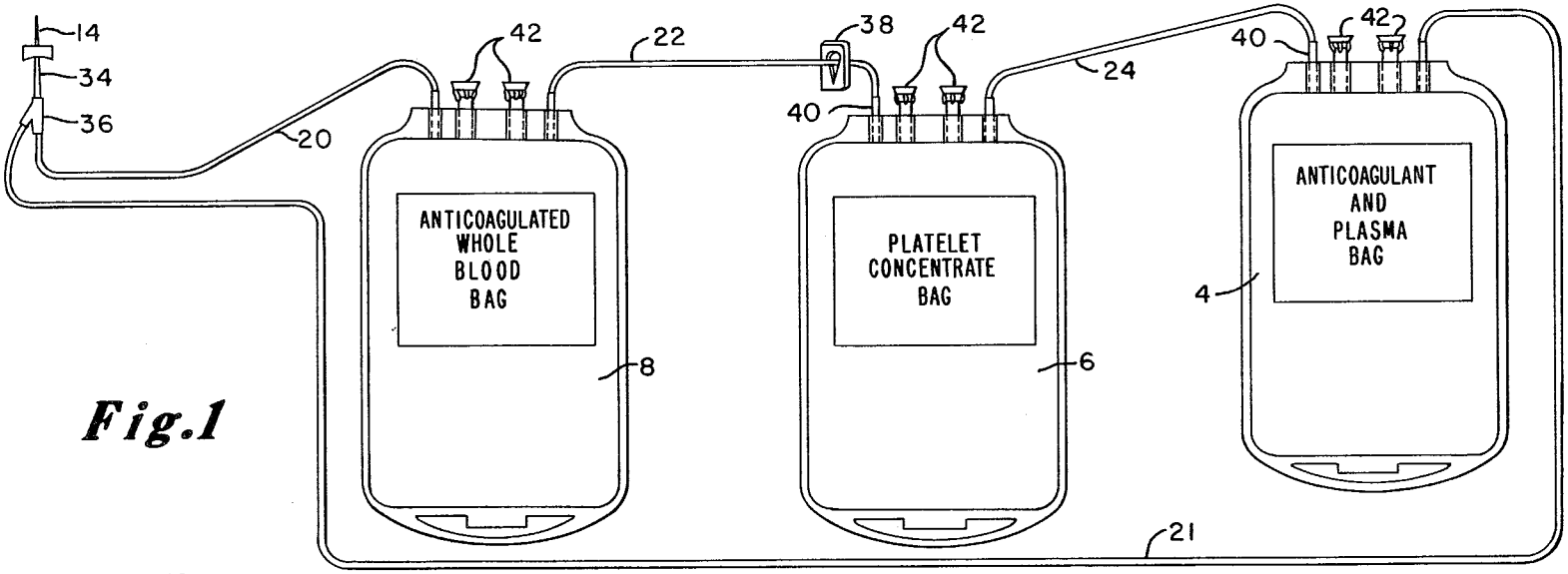
FIG. 1 is a schematic, side elevational view of a paper stacker constructed in accordance with the present invention with the exterior housing removed.

The figures illustrate a paper stacker constructed in accordance with the present invention for receiving an endless pre-folded paper web 3 from a printer machine whereupon the paper web is laid down or stacked in zig-zag layers one above the other to form a vertically growing paper stack 15 on a stationary stack support or deposit surface 1. A piler device 2 is mounted for vertical movement within the paper stacker for engaging the entering paper web and causing it to fold along the pre-existing transverse crease lines for layering on the stack 15. The paper web 3 is supplied from the printer and fed vertically downward into the stacker conducted through a nip formed between parallel disposed, rotating feed roll means, tension roller 4 and pressure roller 5.

As shown in FIG. 1, laterally extending rotatable paddle shafts 13 may be provided on the piler device 2 to engage the entering paper web and fold it along the existing crease lines. In addition, positioning bars 14 may be provided in the neighborhood of the paddle spindles 13 for extending downwardly from the piler 2 to even the opposed side edges of the growing stack.

Figure 2:
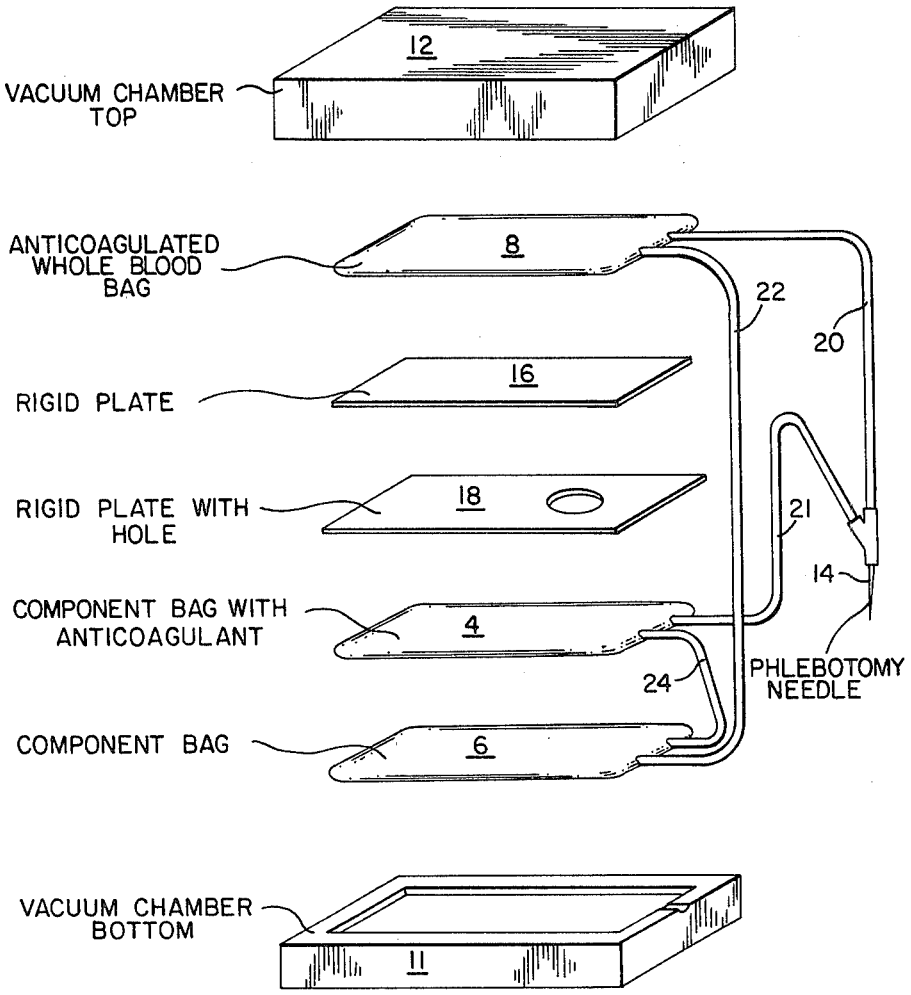
FIG. 2 is a plan view taken along the lines II—II of FIG. 1.
Figure 1:
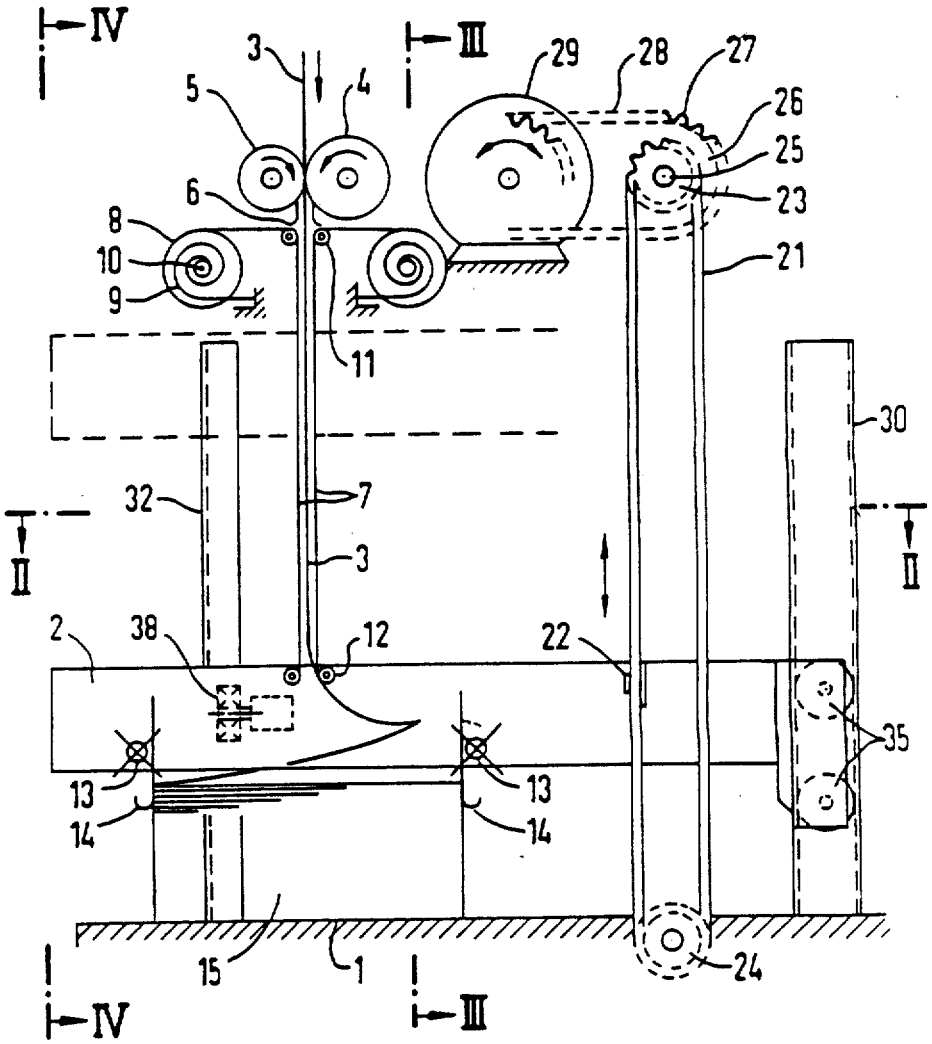
Figure 2:
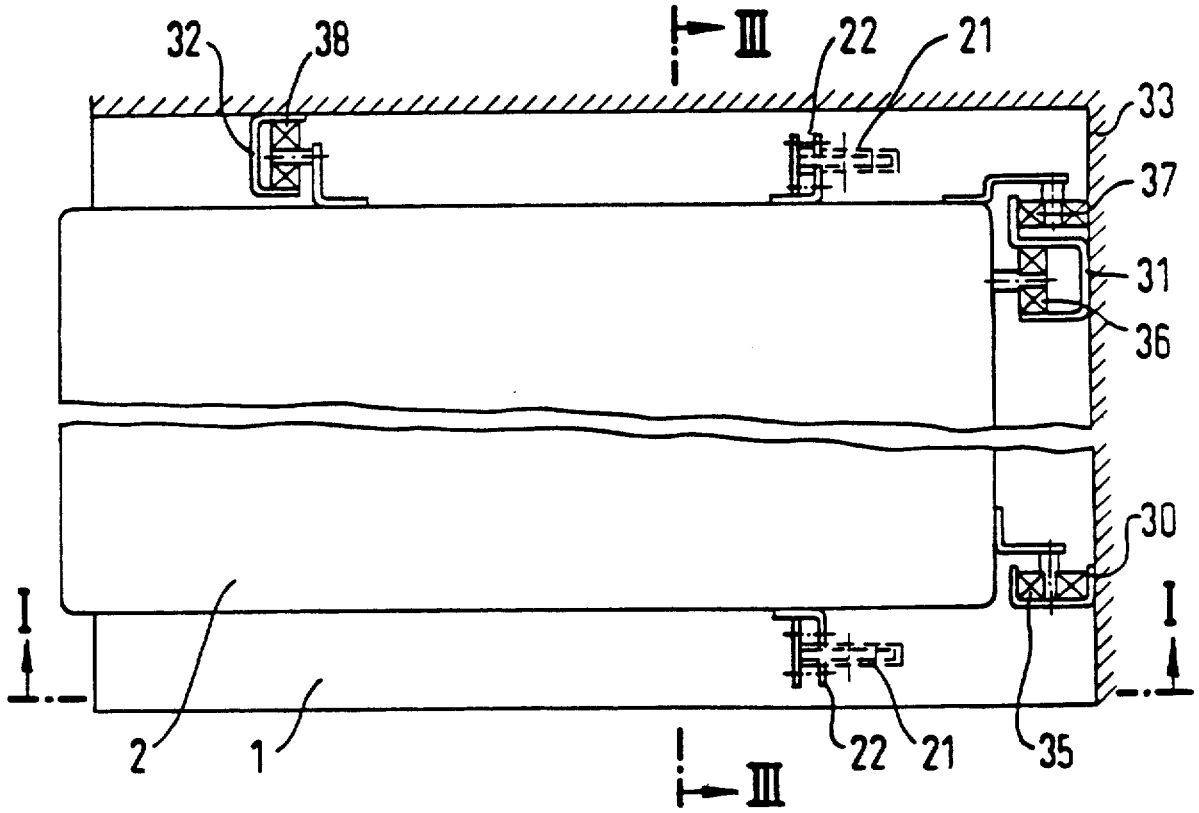
Figure 3:
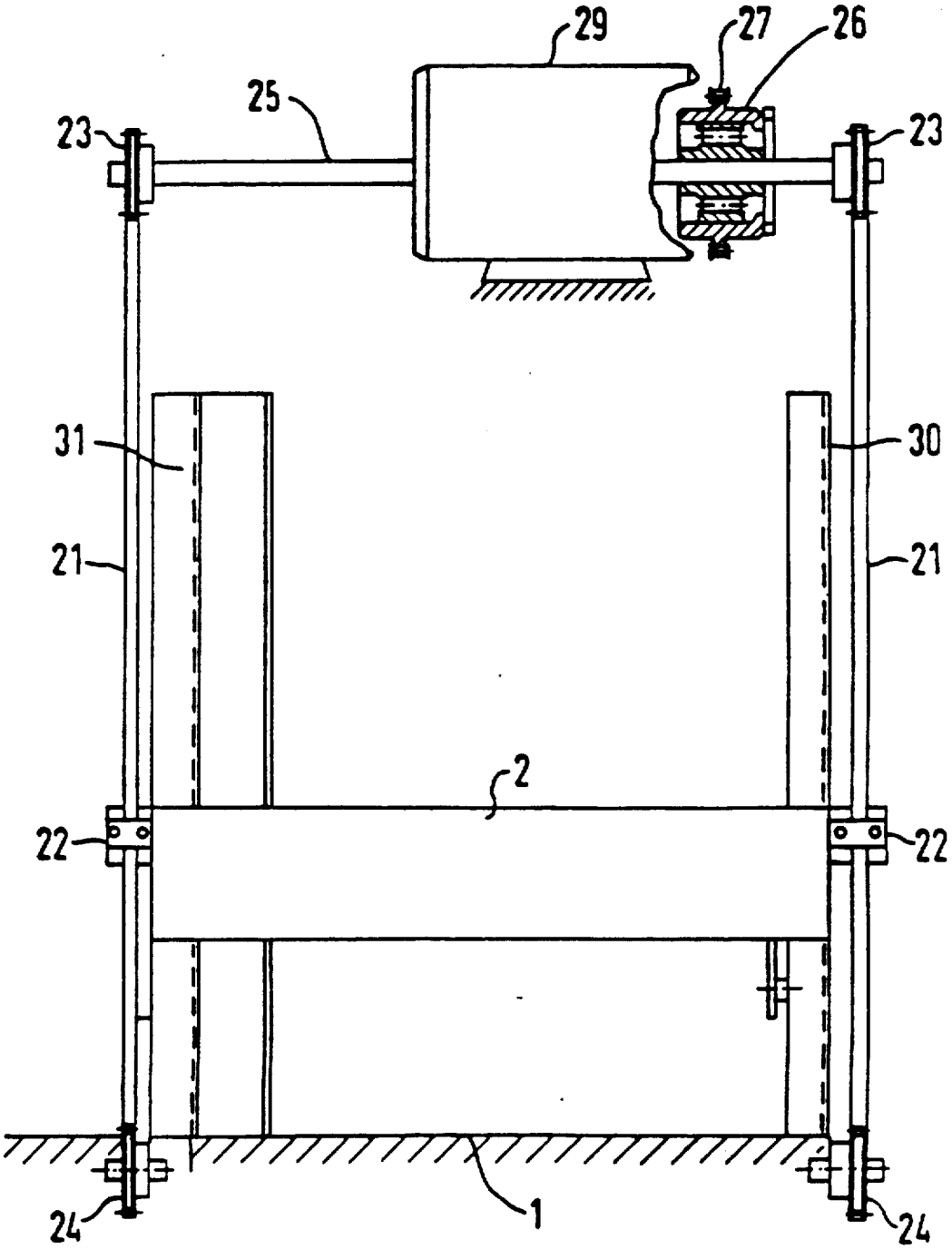

With reference to FIG. 2, the piler device 2 is suitably supported for movement along vertically extending guide tracks 30, 31, and 32 extending upwardly from the deposit surface 1 disposed along at least two sides of the piler. The guide tracks are mounted against an adjacent housing wall 33. The piler 2 is supported for movement in the guide tracks by means of suitable rotatable guide rollers 35, 36, 37, and 38 suitably confined for sliding movement in the tracks.

Figure 3:
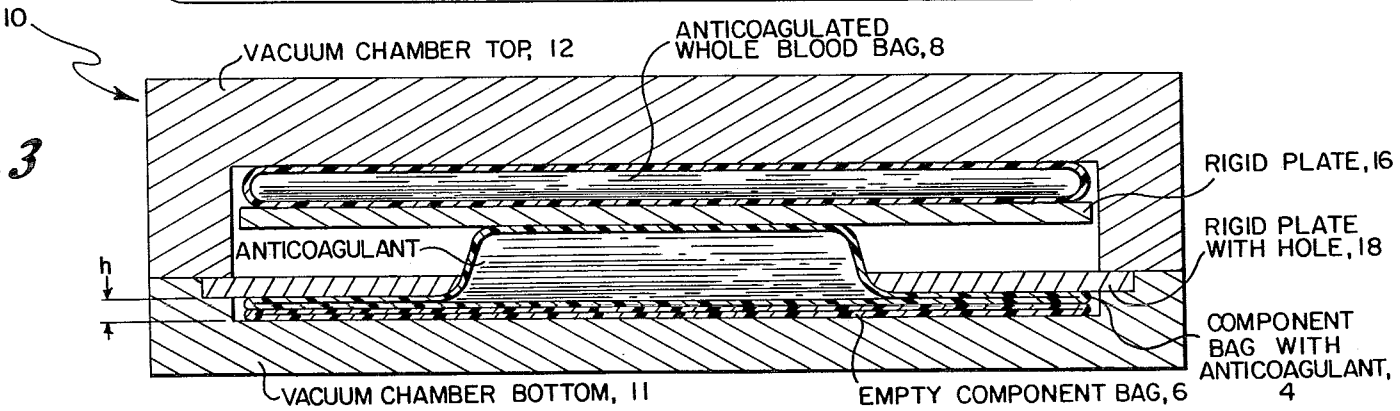
FIG. 3 is a cross-sectional view taken along the lines III—III of FIG. 1.

As shown in FIGS. 2 and 3, the piler device 2 is supported for vertical movement by means of clamp elements 22 mounted on opposed sides of the piler connected to two respective continuous chains 21, each respectively threaded about vertically spaced, end sprockets 23 and 24 mounted for rotation on a common, laterally extending rotary 25. The shaft 25 is driven by a reversible electric motor 29 having a suitable, selectively controllable armature stop brake. The motor 29 has an output gear which is connected via a chain 28 to a drive pinion 27 of a free-wheel 26 coupled for rotation with the shaft 25. The free-wheel 26 is constructed in a known manner having an inner ring which is rigidly connected to the shaft 25, such as for example by means of a feather key or one-way clutch, and an outer ring which is rigidly connected to the pinion 27.

When the motor 29 is stopped, the free-wheel 26 is blocked by the dead weight of the piler device 2. In this manner, rotation of the shaft 25 is arrested and the piler 2 remains at the working height in the stacker which it has assumed during stacking operation. By means of turning the motor 29 on, this working height of the piler can be changed in steps or in continuous fashion so that the piler is raised upwardly over the growing stack 15 or lowered downwardly by virtue of the dead weight force of the piler acting on the inner ring of the free-wheel 26 depending upon the direction in which the motor 29 turns. Suitable limit switches may be arranged in the stacker to control movement of the piler 2 upwardly or downwardly via on-off control of the motor 29.

In accordance with the invention, the piler device 2 can also be manually lifted within the stacker as desired. As the piler 2 is manually lifted, tension on the continuous chains 21 is relieved and the clutch or key of the free-wheel 26 is released. The rotary shaft 25 then turns without load beneath the outer ring of the free-wheel 26, regardless of whether or not the motor 29 is in a driving mode. This results in that the motor 29 is automatically uncoupled from positive drive connection with the shaft 25 during lowering of the piler device 2. This uncoupling preferably occurs when the piler 2, while being lowered, strikes against a suitable detent means (not shown) which leads to a relieving of the tension on the continuous chains 21 by virtue of the weight of the piler 2 without requiring the motor 29 to be immediately shut off.

The particular drive arrangement described above substantially corresponds to known drive systems used for the raising and lowering of movable stack support or deposit surfaces in conventional, known paper stackers. However, this drive arrangement offers significant advantages in conjunction with the height-adjustable piler device 2 of the present invention. For example, the drive system elements are now designed for handling a significantly lower weight and, in the event of stacking errors or unexpected power outages, the piler device 2 can easily be lifted by hand in order to permit correcting of the stacking error or removal of the paper stack from the stacker.

Figure 4:
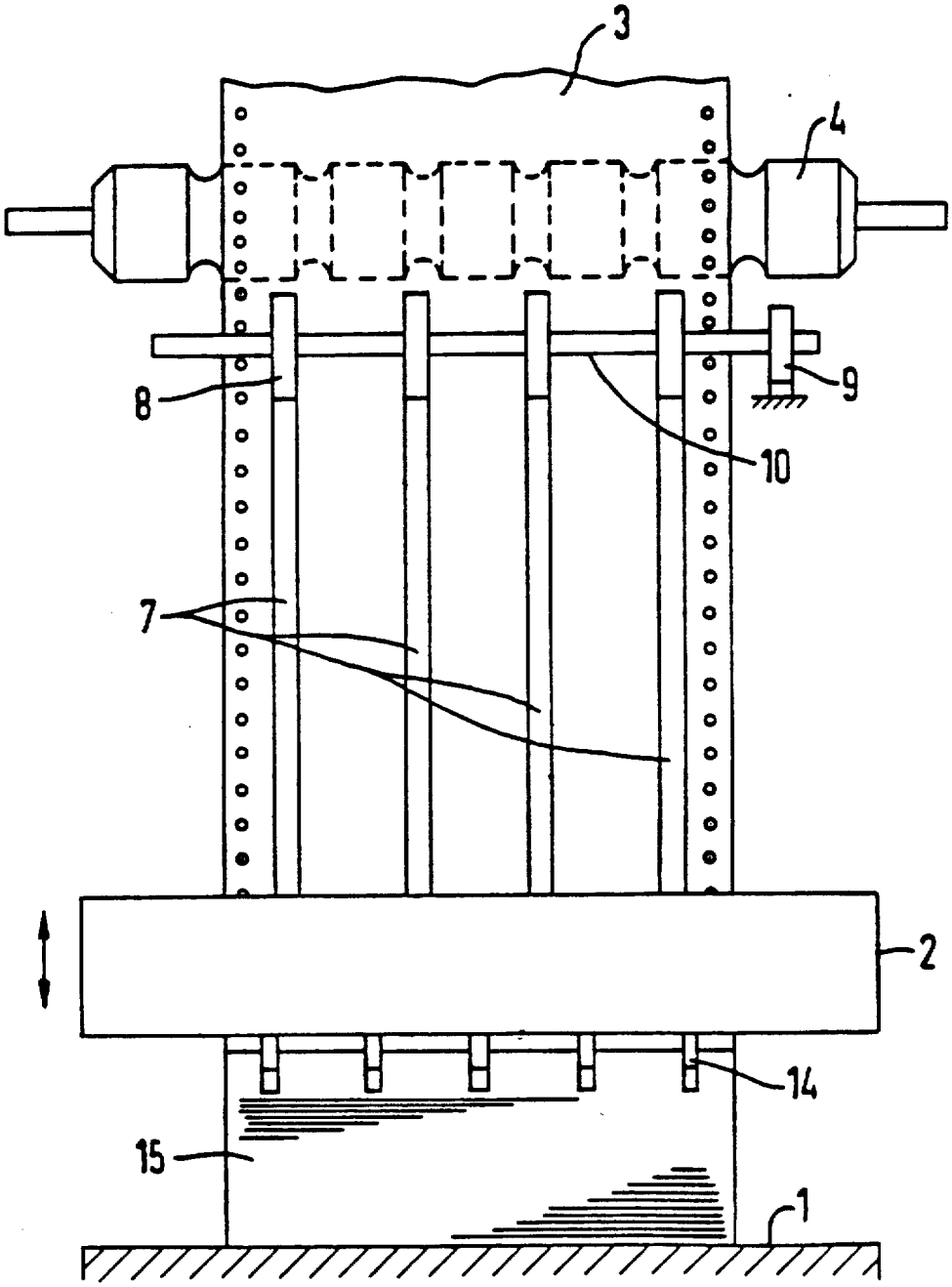
FIG. 4 is a front elevational view taken along the lines IV—IV of FIG. 1.

The paper web 3 is guided in the following manner for downward vertical movement in the stacker to the piler device 2. Fixed guide surfaces 6 are provided immediately beneath the nip formed by the feed roll means 4 and 5 to direct the feed of the paper web 3 vertically downward immediately upon discharge from the feed roll means. In addition, the present invention calls for variable length paper guidance means which serve to conduct the paper web 3 between the open end of the fixed guide walls 6 and the piler 2. These additional paper guidance means must necessarily adapt to the changing working height of the piler device 2 relative to the feed roll means 4 and 5 during stacking operation. As shown in FIG. 4, this additional paper guidance means comprises, in accordance with the preferred embodiment, a series of flexible material bands 7 spaced apart from one another at equal intervals across the width of the paper web 3 perpendicular to the direction of motion of the paper web 3 in the stacker and disposed on opposed face sides of the paper web 3 in corresponding facing pairs to form a plurality of vertically directed guide channels through which the web 3 is conducted downwardly from the feed roll means to the piler 2. The bands of each corresponding pair are spaced relatively closely across from one another rendering the respective guide channels suitably narrow to prevent collapse of the pre-folded web 3 which would lead to disruption of the deposit flow of the web in the stacker. The lower ends of the bands are each secured adjacent the upper end of the piler 2 on two parallel, spaced rods 12. The lower end connection of the bands to the rods 12 serves to define a paper discharge opening into the piler device 2 from which the paper web 3 is received and folded along its preformed crease lines for layering in zig-zag fashion on the stack 15. The upper ends of the bands are connected to respective winding rollers 8 via a pair of parallel, spaced guide rods 11 disposed beneath the lower free ends of the fixed guide walls 6. The winding rollers 8 are divided into groups disposed on opposed sides of the paper web 3 with each group being connected for rotation to a laterally extending common shaft 10 having a longitudinal axis parallel to the longitudinal axis of the rods 12. Each shaft 10 is biased for rotation in a direction which permits winding of the bands 7 on the rollers 8 by suitable shaft tensioning means, such as resilient coiled or helical spring bands 9. In this manner, the bands 7 are provided with a wind-up tension which enables the bands to be retracted upwardly as the piler device 2 moves upwardly in the stacker and unwound under tension so as to remain taut as the piler 2, under its own dead weight force, is lowered in the stacker. The windup bias on the guidance bands 7 enables the vertical guide channel for conducting the paper web 3 between the feed roll means 4 and 5 and the piler 2 in the stacker to be automatically variable in length in constant accordance with the changing relative working height of the piler during stacking operation.

It is also within the contemplation of the present invention to use a single broad band on each of the opposed sides of the paper web 3 to form the guide channel directing the paper web downwardly in the stacker to the piler 2; however, the use of a plurality of narrow bands 7 offers the advantage that the paper web is aerated better along the path from the feed roll means 4 and 5 to the piler 2, which promotes drying of the print and also allows the paper to cool off better after being heated in the fixing station of the printer. In addition, the use of a plurality of spaced apart narrow bands 7 enables the operator to more easily observe movement of the paper web 3 in the stacker and affords the operator more access space to attend to the paper in the stacker in the case of a disruption in the paper web movement.

It is further within the contemplation of the present invention to achieve a guidance means for movement of the paper web 3 in the stacker which is automatically length adjustable in accordance with the relative vertical movement of the piler device 2 by means of vertically directed telescoping elements disposed between the feed roll means 4 and 5 and the upper surface of the piler. This arrangement has the disadvantage of being more costly than the flexible band construction shown in FIG. 4; however, it may be accomplished by means of, for example, stationary guide tracks which are rigidly attached at an upper end beneath the feed roll means 4 and 5 and over which guide tracks correspondingly aligned track elements are slidably movable having lower ends attached to the piler device 2.

It is still further within the contemplation of the present invention to provide a guidance means which is formed in the manner of the bands 7 shown in FIG. 4, but wherein these bands are made of elastic material, such as rubber bands, rubber ropes, or thin helical springs. These elastic bands would be fixedly connected at their upper ends to suitable mounting posts, thus eliminating the need for the self-actuating windup roller system shown in FIG. 4, and their lower ends to suitable mounting means in the piler device 2. By virtue of their elasticity, these bands would be able to automatically expand and contract because of their inherent spring power in accordance with the necessary length requirements dictated by movement of the piler 2 in the stacker.

The bands 7 may be made of non-conductive synthetic material or, on the other hand, be made of metal or some other conductive material such as a conductive synthetic, given appropriate grounding. This offers the advantage that disruptive charging of the paper web 3 as a result of friction along the guide channel or channels is avoided and those charges which already exist are dissipated.

Although various minor modifications may be suggested by those versed in the art, it should be understood that we wish to embody within the scope of the patent warranted hereon all such modifications as reasonably and properly come within the scope of our contribution to the art.

We claim as our invention:

1. In a paper stacker for receiving an endless paper web having prearranged longitudinally spaced lateral crease lines and laying down said web in folded fashion at said crease lines to form a vertical paper stack, a stationary deposit surface for supporting said stack, a piler means over said stack for folding said web onto said stack, drive means for moving said piler means in said stacker to substantially maintain a constant spacing between said piler means and the top of said stack, said piler means having rollers disposed for sliding movement in upstanding guide track means, mounting means associated with said guide track means to restrain said piler means to move in a vertical direction only, and guidance means extending upward a given distance from said piler means for guiding said web to said piler means without buckling said crease lines, means for automatically adjusting the vertical distance of said guidance means in accordance with the relative movement of said piler means in said stacker and having a discharge opening on said piler means so as to be substantially spaced vertically at a constant distance over the top of said stack such that said crease lines cause said web to fold for stacking onto said stack.

2. The stacking device of claim 1, wherein said guidance means comprise at least one pair of vertical elements disposed on opposed face sides of said web forming a guide channel therebetween through which said web is conducted to said piler means.

3. The stacking device of claim 2, wherein said guide channel comprises a plurality of narrow individual channels laterally spaced apart from one another along the width of said web formed by corresponding plural pairs of said vertical elements.

4. The stacking device of claim 1, wherein said guidance means comprises at least one pair of vertically extending, flexible bands disposed on opposed face sides of said web forming a guide channel through which said web is conducted to said piler means, said bands being connected at their lower ends to said piler means and at their upper ends to means placing said bands under tension.

5. The stacking device of claim 4, wherein there are plural said pairs of bands forming plural said guide channels laterally spaced apart from one another along the width of said web.

6. The stacking device of claim 4, wherein said means for placing said bands under tension comprises a pair of rotatably biased shafts disposed on opposed face sides of said web and having corresponding portions about which said bands are wound and unwound.

7. The stacking device of claim 6, wherein said shafts are biased for rotation by means of helical band springs.

8. The stacking device of claim 4, wherein said bands are made of resilient, elastic material.

9. The stacking device of claim 1, wherein said guidance means comprises at least one vertically extending, flexible band disposed along one face side of said web and connected at its lower end to said piler means and at its upper end to means placing said band under tension.

10. The stacking device of claim 1, wherein said drive means comprises an endless chain threaded about spaced apart sprockets, one of said sprockets connected for rotation to a reversible motor having controllable brake means.

* * * * *

UNITED STATES PATENT AND TRADEMARK OFFICE

CERTIFICATE OF CORRECTION

PATENT NO. : 4,474,567

DATED : October 2, 1984

INVENTOR(S) : Mugrauer et al

It is certified that error appears in the above-identified patent and that said Letters Patent is hereby corrected as shown below:

The title page showing the illustrative figure should be deleted to be replaced with the attached title page.

Sheets 1-4 of the drawings should be deleted to be replaced with Sheets 1-4 of drawings, consisting of Figs. 1-4, as shown on the attached pages.

Signed and Sealed this

Ninth Day of June, 1992

*Attest:*

DOUGLAS B. COMER

*Attesting Officer*

*Acting Commissioner of Patents and Trademarks*

United States Patent [19]

Mugrauer et al.

[11] Patent Number: 4,474,567

[45] Date of Patent: Oct. 2, 1984

[54] PAPER STACKER FOR A PRE-FOLDED CONTINUOUS PAPER WEB

[75] Inventors: Hubert Mugrauer, Poering; Gerhard Mueller, Taufkirchen; Friedrich De Carli, Munich, all of Fed. Rep. of Germany

[73] Assignee: Siemens Aktiengesellschaft, Berlin & Munich, Fed. Rep. of Germany

[21] Appl. No.: 541,059

[22] Filed: Oct. 12, 1983

Related U.S. Application Data

[63] Continuation of Ser. No. 366,358, Apr. 7, 1982, abandoned.

[30] Foreign Application Priority Data

Apr. 16, 1981 [DE] Fed. Rep. of Germany ..... 3115511

[51] Int. Cl.[3] ..... B65H 45/00

[52] U.S. Cl. ..... 493/410

[58] Field of Search ..... 270/30; 493/409–415

[56] References Cited

U.S. PATENT DOCUMENTS 3,917,250 11/1975 Brainick ..... 270/30
3,942,300 3/1976 White ..... 270/30 X
4,054,283 10/1977 Rayfield .
4,172,592 10/1979 Müller et al. .

FOREIGN PATENT DOCUMENTS 1236895 10/1965 Fed Rep. of Germany ..... 493/415
2435054 2/1976 Fed. Rep. of Germany .

*Primary Examiner*—A. J. Heinz
*Attorney, Agent, or Firm*—Hill, Van Santen, Steadman & Simpson

[57] ABSTRACT

A stacking device for pre-folded endless paper web in a paper stacker is provided with a stationary stack support or deposit surface and a piler means disposed for movement over the deposit surface for receiving and folding the paper web along its crease lines in zig-zag layers on the paper stack. The invention offers the advantage that the movable elements of the paper stacker have significantly lighter and constant masses, so that the inventive structure may be made less expensively than conventional, known paper stacker arrangements. Between the feed roll means delivering the paper web into the stacker and the relatively movable piler, there is provided a guidance means for conducting the paper web in non-collapsing fashion downwardly within the stacker to the piler. The guidance means is constructed so as to automatically vary in length in accordance with the changing working height of the piler during stacking operation. The guidance means may be in the form of a plurality of synthetic bands provided along opposed sides of the paper web wherein the bands are connected at their upper ends to automatic tensioning means which maintain the bands under tension and allow the bands to lengthen or contract in accordance with the relative movement of the piler.

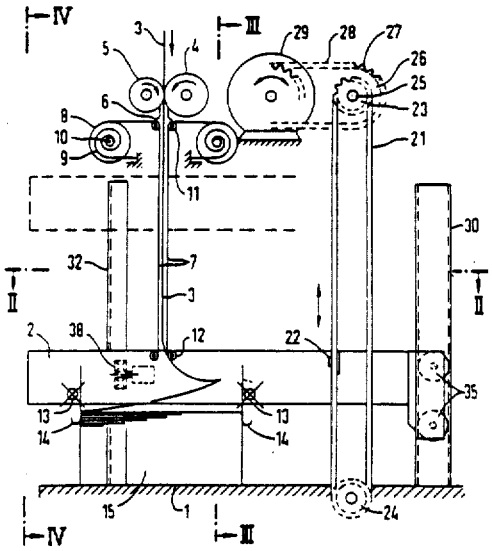

10 Claims, 4 Drawing Figures